US009078474B2

(12) United States Patent
Thompson

(10) Patent No.: US 9,078,474 B2
(45) Date of Patent: Jul. 14, 2015

(54) CARTOMIZER FOR ELECTRONIC CIGARETTES

(76) Inventor: Spencer Thompson, Newbury Park, CA (US)

( * ) Notice: Subject to any disclaimer, the term of this patent is extended or adjusted under 35 U.S.C. 154(b) by 837 days.

(21) Appl. No.: 13/360,843

(22) Filed: Jan. 30, 2012

(65) Prior Publication Data

US 2013/0192617 A1 Aug. 1, 2013

(51) Int. Cl.
*A24F 47/00* (2006.01)

(52) U.S. Cl.
CPC ..... *A24F 47/008* (2013.01)

(58) Field of Classification Search
CPC ..... A24F 47/008
USPC ..... 131/270, 273
See application file for complete search history.

(56) References Cited

U.S. PATENT DOCUMENTS 8,903,228 B2 * 12/2014 Goodman et al. ..... 392/404
2005/0016550 A1 1/2005 Katase
2010/0242974 A1 9/2010 Pan
2011/0011396 A1 * 1/2011 Fang ..... 128/202.21
2011/0094523 A1 * 4/2011 Thorens et al. ..... 131/194
2011/0155153 A1 * 6/2011 Thorens et al. ..... 131/329
2011/0265806 A1 11/2011 Alarcon et al.
2013/0087160 A1 * 4/2013 Gherghe ..... 131/329
2013/0192617 A1 * 8/2013 Thompson ..... 131/329
2014/0318559 A1 * 10/2014 Thorens et al. ..... 131/329

* cited by examiner

*Primary Examiner* — Richard Crispino
*Assistant Examiner* — Dionne W Mayes
(74) *Attorney, Agent, or Firm* — Kelly & Kelley, LLP

(57) ABSTRACT

A cartomizer for an electronic cigarette having an elongated, hollow body with a mouthpiece in a first end and a battery coupling in an opposite second end. An atomizing coil is disposed in the body generally perpendicular to a longitudinal axis of the cartomizer and has positive and negative terminal leads pressfit connected to positive and negative terminals separated by an insulative spacer in the battery coupling. A fibrous wick is inserted inside the atomizing coil and a cloth tube is disposed generally parallel to the longitudinal axis of the cartomizer and extends from the atomizing coil to the mouthpiece. A volatile liquid mixture of preferably 80% propylene glycol and 20% veggie glycol with liquid nicotine and/or flavoring is disposed in the body.

18 Claims, 4 Drawing Sheets

CARTOMIZER FOR ELECTRONIC CIGARETTES

BACKGROUND OF THE INVENTION

The present invention relates generally to electronic cigarettes. More particularly, the present invention is directed to a cartomizer for use with electronic cigarettes.

As is well known, cigarette smoking is not only harmful to the person smoking, but is also harmful to other people around the smoker due to second-hand smoke. In addition, a lit cigarette may cause a fire if the cigarette is not properly extinguished. Recently, various types of smoking simulators for tasting a flavor resembling that of a cigarette without burning a cigarette have been proposed.

For example, smoking simulators have been proposed, in which a heating element and solid flavor generating medium are provided in a heat-insulating tube and in which the heat-insulating tube and a power supply of the heating element are wrapped in fine quality wrapping paper and formed like a cigarette (for example, see Japanese Patent Laid-Open No. JP-A-3-232481). In a smoking simulator having such a configuration, electrical energy is supplied from the power supply to the heating element to heat the flavor generating medium which in turn generates flavor components. A flavor resembling that of a cigarette can be tasted by inhaling a gaseous mixture of the flavor components and air which has been taken into the smoking simulator.

In a smoking simulator having such a configuration, however, since it takes time to increase the temperature of the flavor generating medium, a long time is required for the flavor generating medium to generate a sufficient amount of flavor components. Thus, a sufficient amount of flavor components cannot be obtained at the beginning of simulated smoking, and a feeling similar to that of a cigarette cannot be provided from the beginning of simulated smoking. Since the amount of flavor components generated by the flavor generating medium cannot be controlled with high accuracy, the amount of flavor components cannot be adjusted according to the amount of inhalation. As a result, a feeling similar to that of a cigarette cannot be provided. Further, since there is no function of generating smoke similar to that of a cigarette and no function of generating a fire similar to that of a cigarette, a feeling similar to that of a cigarette cannot be provided.

Another configuration for an electronic cigarette has a resistance coil disposed along the length of the cigarette such that a volatile flavoring liquid is vaporized upon heating by the coil. Drawbacks of this configuration include that as the flavoring liquid is consumed, portions of the resistance coil disposed along the length of the cigarette are no longer submerged in the liquid and subject to corrosion and/or failure. Such corrosion and/or failure can result in inconsistent and/or incomplete use of the electronic cigarette. Such can also result in fire or other hazard leading to injury or damage. A damaged coil may become too hot and produce a bad taste, i.e., electrical or fire taste.

Therefore, there is a need for an electronic cigarette device where the resistance coil is not as readily exposed to such corrosion and/or failure. It is an object of the present invention to provide an electronic cigarette that fulfills these needs and provides other related advantages.

SUMMARY OF THE INVENTION

The present invention is directed to a cartomizer for an electronic cigarette. The cartomizer comprises an elongated, hollow body having a mouthpiece in a first end and a battery coupling in an opposite second end, said battery coupling having a positive terminal and a negative terminal. An electrically insulative spacer is pressfit between the positive and negative terminals. An atomizing coil is disposed generally perpendicular to a longitudinal axis of the cartomizer and has positive and negative terminal leads. The positive and negative terminal leads are pressfit between the insulative spacer and the respective positive or negative terminal forming a physical and electrical connection.

A fibrous wick is inserted inside the atomizing coil. A cloth tube is disposed inside the elongated, hollow body generally parallel to the longitudinal axis of the cartomizer and extends from the atomizing coil to the mouthpiece. An air intake vent is disposed in the battery coupling and is in communication with a central passageway through the battery coupling, elongated hollow body, and mouthpiece.

A volatile liquid mixture of an alcohol and a glycerol is disposed in the elongated, hollow body surrounding the atomizing coil. The volatile liquid mixture preferably comprises 80% propylene glycol and 20% veggie glycol. The volatile liquid mixture also preferably comprises liquid nicotine and/or flavoring.

A silicone rubber barrier is disposed in the elongated, hollow body proximate to the first end. A silicone rubber ring is disposed about the battery coupling in the second end of the elongated, hollow body. The silicone rubber barrier and silicone rubber ring together seal the elongated, hollow body against leaks so as to retain the volatile liquid mixture within the cartomizer.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
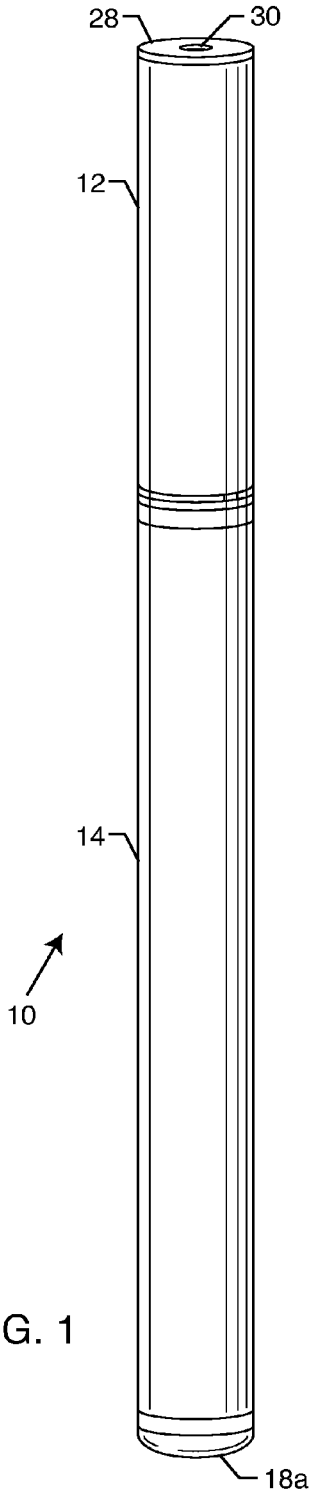
FIG. 1 is an illustration of an electronic cigarette according to the present invention, including the cartomizer and a battery base.
Figure 2:
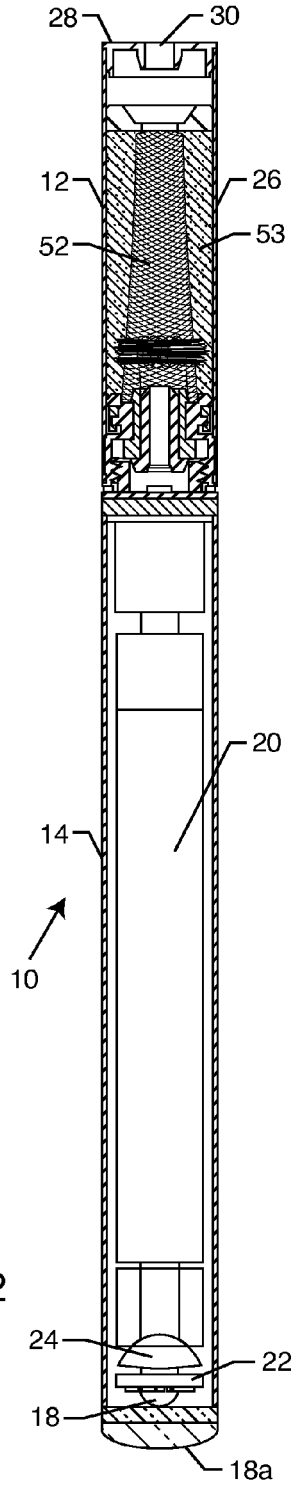
FIG. 2 is a cross-sectional view of the electronic cigarette of FIG. 1.
Figure 3:
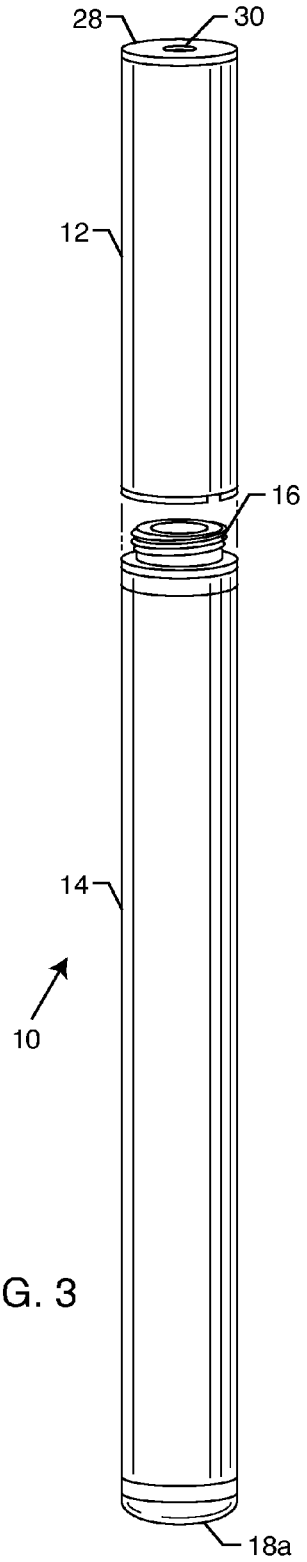
FIG. 3 is an exploded view of the electronic cigarette of FIG. 1 where the cartomizer is separated from the battery base.

As shown in the exemplary drawing, for purposes of illustration, the present disclosure for the electronic cigarette is referred to generally by the reference number 10. As illustrated in FIGS. 1-3, the electronic cigarette comprises two main components—a cartomizer 12 and a battery base 14.

The battery base 14 has a base coupling 16 at one end and an LED light 18 with a lens 18*a* at the opposite end. A battery cell 20 included in the battery base 14 is electrically connected to the base coupling 16 and the LED light 18. A smart chip 22 is disposed in the electrical connection between the battery cell 20 and the LED light 18 to control operation of the electronic cigarette 10. An air flow switch 24 is also disposed in the electronic connection between the battery cell 20 and the LED light 18 so as to automatically switch on when it detects inhalation on the electronic cigarette 10. The configuration of such a battery base 14 is typical in prior art electronic cigarettes and will be understood by those skilled in the art.

Figure 4:
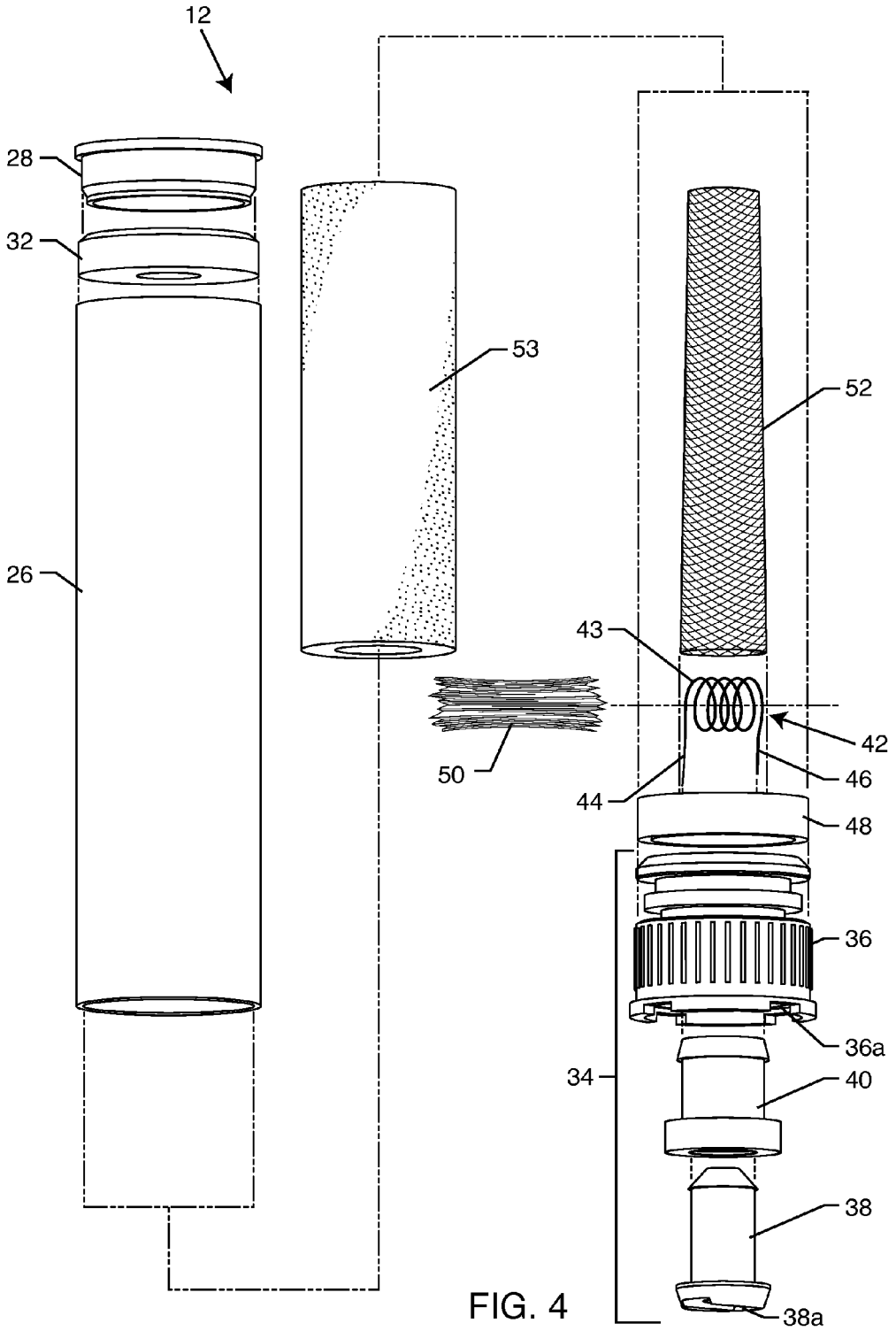
FIG. 4 is an exploded view of the cartomizer, illustrating assembly of the same.

The cartomizer 12, the assembly of which is illustrated in FIG. 4, comprises a generally elongated, hollow body or sleeve 26. A first end of the body 26 includes a mouthpiece 28. This mouthpiece 28 preferably comprises a plastic or silicone rubber cap including an inhalation hole 30 therethrough. As will be described more fully below, this inhalation hole 30 connects to a central passageway (described below) through the electronic cigarette such that it reaches the airflow switch 24 in the battery base 14. A silicone rubber liquid barrier 32 is disposed in the body 26 proximate to the mouthpiece 28. The silicone rubber liquid barrier 32 seals the first end of the body 26 against leakage of the flavor liquid as explained below.

The opposite second end of the body 26 has a battery coupling 34 configured to join with the base coupling 16 on the battery base 14. A silicone rubber ring is disposed around a portion of the outer terminal 36 so as to create a watertight liquid seal between the body 26 and the portion of the outer terminal 36 that is inserted therein. The couplings 16 and 34 include electrically isolated positive and negative terminals as described more fully below. When the couplings 16 and 34 are connected, their matching positive and negative terminals are also connected to create an electrical connection between the cartomizer 12 and the battery base 14. The couplings 16 and 34 are preferably threaded couplings, but may comprise any known form of coupling, including lugs and channels, snap-fit, or other similar connection means.

In a preferred embodiment, the battery coupling 34 comprises an outer terminal 36 and an inner terminal 38. The outer terminal 36 and the inner terminal 38 are concentrically disposed in the second end of the body 26 and have central passageways 37. The outer terminal 36 includes air intake vents 36*a* around its perimeter to allow air into the central passageway (described below) during inhalation. The inner terminal 38 also includes air vents 38*a* to connect the air intake vents 36*a* to the central passageway. A silicone rubber gasket 40 is disposed between the outer terminal 36 and the inner terminal 38 so as to prevent leakage and electrically insulate one terminal from the other, thus preventing a short circuit or other electrical failure. The silicone rubber gasket 40 is configured such that the concentric nesting of the outer terminal 36, the silicone rubber gasket 40 and the inner terminal 38 results in a friction or press fit that maintains a tight connection.

Figure 8:
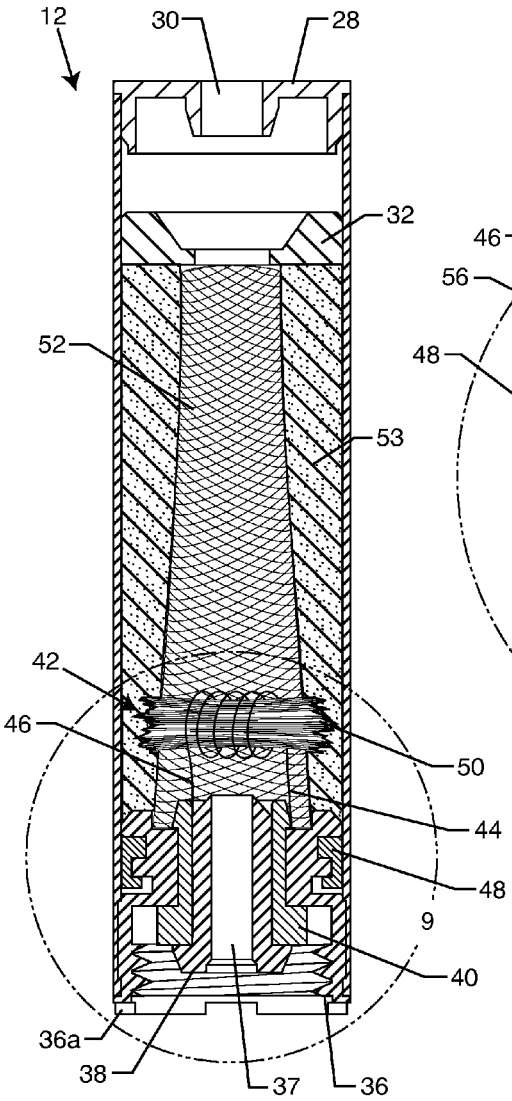
FIG. 8 is a cross-sectional view of the cartomizer of the present invention.
Figure 9:
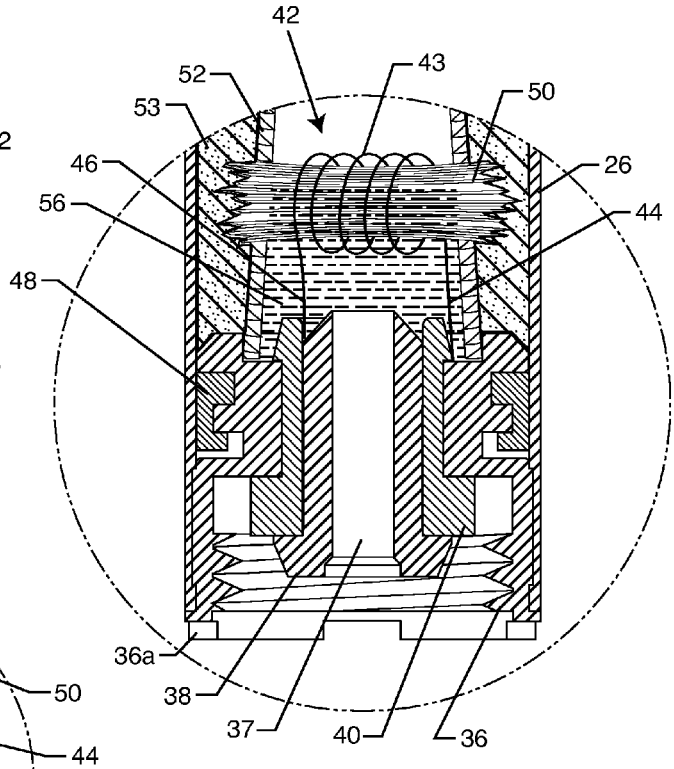
FIG. 9 is a close-up view of the cartomizer of the present invention as illustrated by circle 9 in FIG. 8.

As illustrated most clearly in FIGS. 8 and 9, an atomizing coil 42 is disposed in the body 26 adjacent to the battery coupling 34. The atomizing coil 42 has a body composed of loops of conductive wire 43 ending in positive and negative terminal leads 44, 46. The atomizing coil 42 is disposed horizontally, i.e., transverse to the long axis of the cartomizer 12. This configuration produces the advantageous effect that the coils 43 remain covered or submerged in liquid for a longer duration of use, which reduces or eliminates oxidation or corrosion of the wire—extending its life and effectiveness. This is contrasted with prior art devices having extended coils or heating elements along the length of the cartomizer, wherein the most distal portion of the coils were not wetted or covered by liquid.

The positive terminal lead 44 is pressfit between one of the outer terminal 36 or the inner terminal 38 and the silicone rubber gasket 40. The negative terminal lead 46 is pressfit, i.e., solderless, between the other of the outer terminal 36 or the inner terminal 38 and the silicone rubber gasket 40. The solderless design minimizes the chance of a mechanical failure, i.e., breakage, of the solder. In this configuration, a partial circuit is created from the outer terminal 36 through the positive terminal lead 44, the atomizing coil 42, the negative terminal lead 46, and to the inner terminal 38. A person skilled in the art will realize that the positions of the outer terminal 36 and inner terminal 38 may be switched in this partial circuit with the cartomizer still operating as designed. Opposite ends of the outer terminal 36 and inner terminal 38 are connected to matching components in the battery base 14, i.e., anode and cathode. When the battery coupling 34 is connected to the base coupling 16, the partial circuit described above is completed by connection to matching anode and cathode components in the battery base 14.

Figure 5:
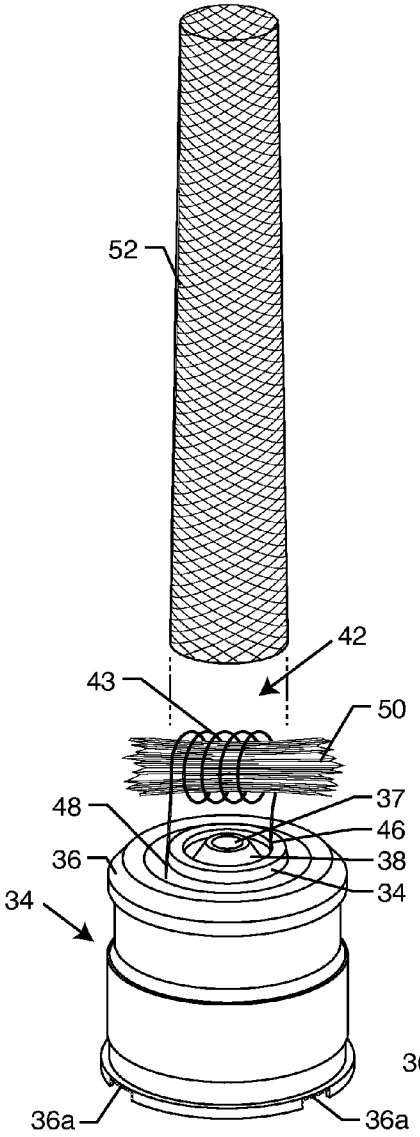
FIG. 5 is a close-up view of the inside of the cartomizer, illustrating assembly of the cloth tubing with the atomizing
Figure 6:
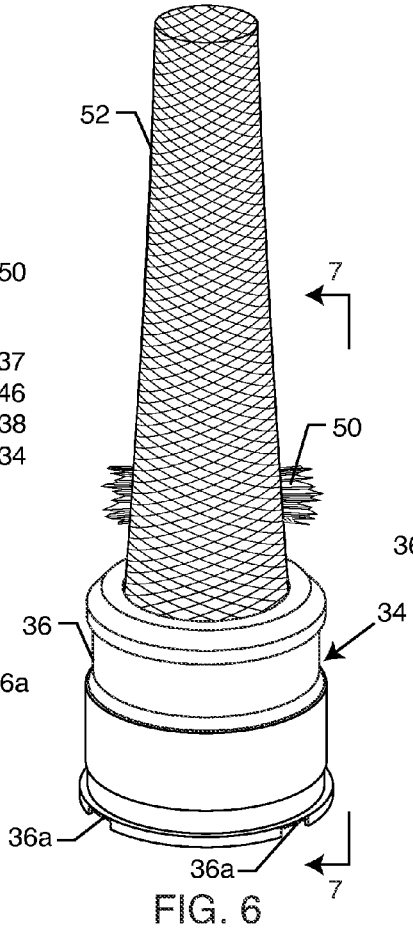
FIG. 6 is a side view of the inside of the cartomizer.
Figure 7:
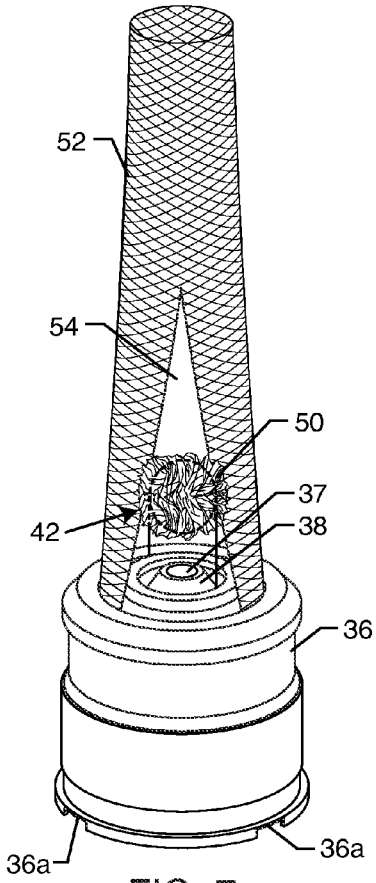
FIG. 7 is an alternate side view of the inside of the cartomizer taken along line 7-7 of FIG. 6.

As clearly shown in FIGS. 5-7, a fibrous wick 50 is inserted through the coils 43 on the atomizing coil 42. An air tunnel 52 in the form of a cloth tube—made from material such as polyethylene terephthalate commercially sold under the name DACRON®—is disposed along the length of the body 26 such that one end of the air tunnel 52 sits over and surrounds the atomizing coil 42. Opposite sides of the same end of the air tunnel 52 include triangular cutouts 54 such that the fibrous wick 50 protrudes through the cutouts 54. The opposite end of the air tunnel 52 is disposed adjacent to the silicone rubber liquid barrier 32 near the mouthpiece 28. The air tunnel 52 comprises part of the central passageway that extends from the inhalation hole 30, through the cartomizer 12 and into the battery base 14. A semi-absorbent packing material 53 surrounds the air tunnel 52 and fills in the gap between the air tunnel 52 and the body 26.

A volatile liquid 56 is contained within the body 26 between the silicone rubber liquid barrier 32 and the silicone rubber ring 48. The semi-absorbent packing material 53 keeps the volatile liquid 56 relatively stationary and maintains contact with the fibrous wick 50 such that it retains moisture. The volatile liquid 56 is absorbed by the fibrous wick 50 and vaporized by the atomizing coil 42 as discussed below. The volatile liquid 56 preferably comprises a mixture of an alcohol and a glycerol. Ideally, the alcohol comprises propylene glycol and the glycerol comprises veggie glycol. A mixture of 80% propylene glycol and 20% veggie glycol produces an optimum result from the electronic cigarette 10. The propylene glycol is commonly used in electronic cigarettes as it is colorless, slightly sweet and produces more flavor. Propylene glycol is often used in smoke/fog machines commonly found in theaters and nightclubs. The veggie glycol is smoother, slightly thicker and sweeter, and produces more vapor than the propylene glycol. Veggie glycol is also known as vegetable glycerin, glycerine or glycerol. Preferably, only medical grade glycerin, i.e., glycerin USP, is used. The mixture of these chemicals produces vapor and provides a similar sensation to inhaling tobacco smoke when the liquid 56 is vaporized by the atomizing coil 42. Liquid nicotine (about 18 mg) and/or a flavoring may be added to the volatile liquid 56 such that the resultant vapor more closely resembles cigarette smoke.

When an electrical current is applied to the atomizing coil 42 it heats up as a resistor. Upon reaching a predetermined temperature, the volatile liquid 56, which has been absorbed into the fibrous wick 50, is vaporized and passes through the air tunnel 52 as vapor simulating cigarette smoke.

Although several embodiments have been described in detail for purpose of illustration, various modifications may be made without departing from the scope and spirit of the invention. Accordingly, the invention is not to be limited, except as by the appended claims.

What is claimed is:

1. A cartomizer for an electronic cigarette, the cartomizer comprising:

an elongated, hollow body having a mouthpiece in a first end and a battery coupling in an opposite second end, said battery coupling having a positive terminal and a negative terminal;

an electrically insulative spacer pressfit between the positive and negative terminals;

an atomizing coil disposed generally perpendicular to a longitudinal axis of the cartomizer and having positive and negative terminal leads, wherein the positive and negative terminal leads are pressfit between the insulative spacer and the respective positive or negative terminal forming a physical and electrical connection.

2. The cartomizer of claim 1, further comprising a fibrous wick inserted inside the atomizing coil.

3. The cartomizer of claim 1, further comprising a cloth tube disposed inside the elongated, hollow body generally parallel to the longitudinal axis of the cartomizer and extending from the atomizing coil to the mouthpiece.

4. The cartomizer of claim 1, further comprising an air intake vent in the battery coupling, said air intake vent communicating with a central passageway through the battery coupling, elongated hollow body, and mouthpiece.

5. The cartomizer of claim 1, further comprising a volatile liquid mixture of an alcohol and a glycerol in the elongated, hollow body, surrounding the atomizing coil.

6. The cartomizer of claim 5, wherein the volatile liquid mixture comprises eighty percent propylene glycol and twenty percent veggie glycol.

7. The cartomizer of claim 6, wherein the volatile liquid mixture further comprises liquid nicotine and/or flavoring.

8. The cartomizer of claim 1, further comprising a silicone rubber barrier disposed in the elongated, hollow body proximate to the first end and a silicone rubber ring disposed about the battery coupling in the second end of the elongated, hollow body.

9. A cartomizer for an electronic cigarette, the cartomizer comprising:

an elongated, hollow body having a mouthpiece in a first end and a battery coupling in an opposite second end, said battery coupling having a positive terminal and a negative terminal;

an electrically insulative spacer pressfit between the positive and negative terminals;

an atomizing coil disposed generally perpendicular to a longitudinal axis of the cartomizer and having positive and negative terminal leads, wherein the positive and negative terminal leads are pressfit between the insulative spacer and the respective positive or negative terminal forming a physical and electrical connection;

a cloth tube disposed inside the elongated, hollow body generally parallel to the longitudinal axis of the cartomizer and extending from the atomizing coil to the mouthpiece; and a volatile liquid mixture of an alcohol and a glycerol in the elongated, hollow body, surrounding the atomizing coil.

10. The cartomizer of claim 9, further comprising a fibrous wick inserted inside the atomizing coil.

11. The cartomizer of claim 9, further comprising an air intake vent in the battery coupling, said air intake vent communicating with a central passageway through the battery coupling, elongated hollow body, and mouthpiece.

12. The cartomizer of claim 9, wherein the volatile liquid comprises eighty percent propylene glycol and twenty percent veggie glycol.

13. The cartomizer of claim 9, wherein the volatile liquid further comprises liquid nicotine and/or flavoring.

14. The cartomizer of claim 9, further comprising a silicone rubber barrier disposed in the elongated, hollow body proximate to the first end and a silicone rubber ring disposed about the battery coupling in the second end of the elongated, hollow body.

15. A cartomizer for an electronic cigarette, the cartomizer comprising:

an elongated, hollow body having a mouthpiece in a first end and a battery coupling in an opposite second end, said battery coupling having a positive terminal and a negative terminal;

an electrically insulative spacer pressfit between the positive and negative terminals;

an atomizing coil disposed generally perpendicular to a longitudinal axis of the cartomizer and having positive and negative terminal leads, wherein the positive and negative terminal leads are pressfit between the insulative spacer and the respective positive or negative terminal forming a physical and electrical connection;

a cloth tube disposed inside the elongated, hollow body generally parallel to the longitudinal axis of the cartomizer and extending from the atomizing coil to the mouthpiece;

a fibrous wick inserted inside the atomizing coil; and a volatile liquid mixture of an alcohol, a glycerol, and liquid nicotine and/or flavoring in the elongated, hollow body, surrounding the atomizing coil and fibrous wick.

16. The cartomizer of claim 15, further comprising an air intake vent in the battery coupling, said air intake vent communicating with a central passageway through the battery coupling, elongated hollow body, and mouthpiece.

17. The cartomizer of claim 15, wherein the volatile liquid comprises 80% propylene glycol and 20% veggie glycol.

18. The cartomizer of claim 15, further comprising a silicone rubber barrier disposed in the elongated, hollow body proximate to the first end and a silicone rubber ring disposed about the battery coupling in the second end of the elongated, hollow body.

* * * * *